United States Patent [19]

LaPointe

[11] Patent Number: 5,061,010

[45] Date of Patent: Oct. 29, 1991

[54] CAM GUIDE DRIVE MECHANISM FOR POWER-ASSISTED CHAIRS AND THE LIKE

[75] Inventor: Larry P. LaPointe, Temperance, Mich.

[73] Assignee: La-Z-Boy Chair Co., Monroe, Mich.

[21] Appl. No.: 613,355

[22] Filed: Nov. 14, 1990

Related U.S. Application Data

[63] Continuation-in-part of Ser. No. 425,384, Oct. 18, 1989, Pat. No. 4,993,777, which is a continuation of Ser. No. 196,750, May 20, 1988, abandoned.

[51] Int. Cl.[5] ..... A47C 1/02

[52] U.S. Cl. ..... 297/325; 297/DIG. 10; 297/330

[58] Field of Search ..... 297/325, 326, 327, 328, 297/330, DIG. 10, 71, 86, 88, 68, 69; 74/89.15, 424.8 R

[56] References Cited

U.S. PATENT DOCUMENTS

| | | | |
|---|---|---|---|
| 942,817 | 12/1909 | Flindall | 297/69 X |
| 3,016,264 | 1/1962 | Hughes | 297/69 |
| 3,934,929 | 1/1976 | Rabinowitz | 297/330 X |
| 4,007,960 | 2/1977 | Gaffney | 297/330 X |
| 4,696,512 | 9/1987 | Burnett et al. | 297/68 |
| 4,722,566 | 2/1988 | Castellini | 297/68 |
| 4,786,107 | 11/1988 | Crockett | 297/330 |
| 4,946,222 | 8/1990 | Matson | 297/325 X |
| 4,993,777 | 2/1991 | LaPointe | 297/325 |

*Primary Examiner*—Peter A. Aschenbrenner
*Attorney, Agent, or Firm*—Harness, Dickey & Pierce

[57] ABSTRACT

The chair of the present invention includes a power-assisted linear actuation drive mechanism having a modified nut or "cam guide" which is linearly moveable upon rotation of the power screw for selectively actuating the lift and tilt linkage mechanism for causing forward lifting and tilting movement of the chair when the motor is operated in a first direction. Rotation of the screw shaft in a second opposite direction acts to lower the chair to the normal seating position. Continued rotation in the second direction causes sequential operative extension of the leg rest assembly followed by angular reclining movement of the chair. This sequential operation of the leg rest assembly and the reclining linkage are independent and may be easily disabled to selectively eliminate either of the features.

25 Claims, 12 Drawing Sheets

FIG 3
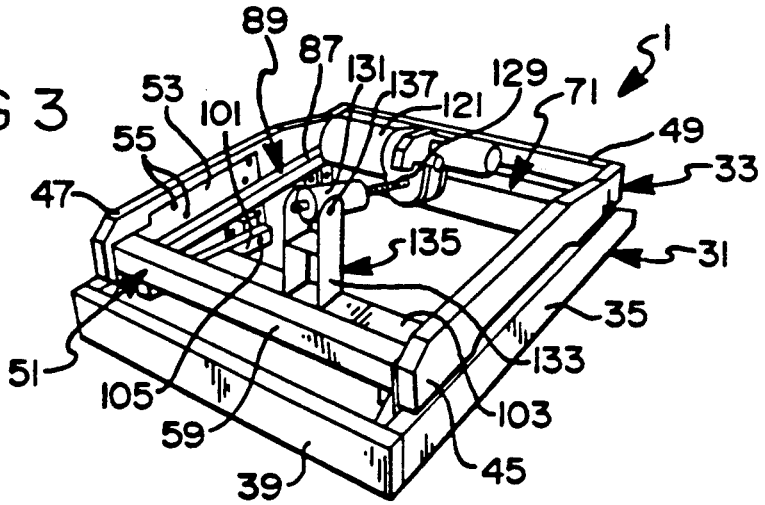
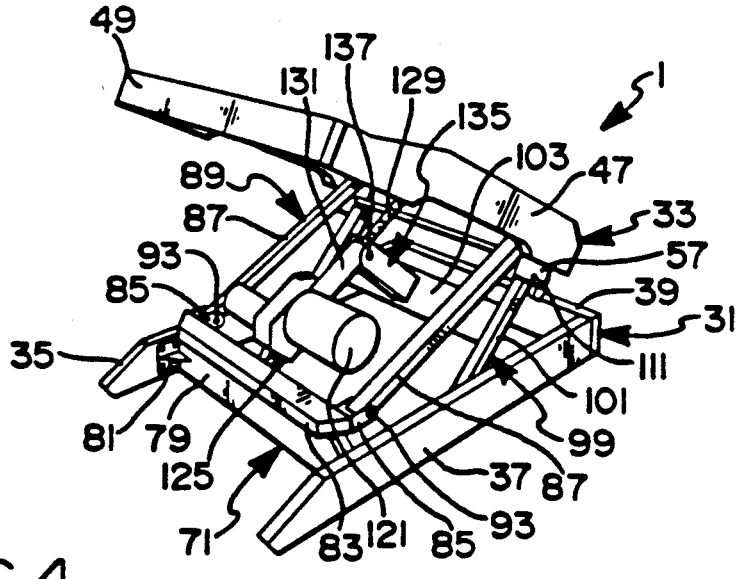
FIG 4

(69)
3
(283)
5
(281)
303
301
279
129
141
121
123
215
217
219
221
225
223
229
227
213
297
207
205
203
231
233
235
237
295
211
201
239
241
249
245
243
247
209
263
261
259
265
267
287
289
291
283
285
255
253
251
257
273
271
269
281
279
271
273
267
293
275
277

CAM GUIDE DRIVE MECHANISM FOR POWER-ASSISTED CHAIRS AND THE LIKE

CROSS-REFERENCE TO RELATED U.S. APPLICATIONS

The present application is a Continuation-In-Part of U.S. Ser. No. 07/425,384 filed Oct. 18, 1989, which is a Continuation of U.S. Ser. No. 07/196,750 filed May 20, 1988, now abandoned.

BACKGROUND OF THE INVENTION

The present invention relates generally to power-assisted articles of furniture and, more particularly, to a multi-function chair having a linear actuation drive mechanism selectively operable for lifting and tilting the chair, extending and retracting a leg rest assembly and reclining the chair between upright and fully reclined positions.

Conventionally, power-assisted chairs typically include a motor-operated lift mechanism for aiding invalids and those persons requiring assistance in entering or exiting the chair. More particularly, motor-operated lift mechanisms are interconnected between a stationary base assembly and a moveable chair frame. Alternatively, some power-assisted chairs include separate linkage mechanisms for permitting the seat occupant to selectively extend and retract a leg rest assembly and/or produce reclining angular movement between an "upright" position and a "reclined" position.

Heretobefore, most conventional power-assisted chairs have not been adapted to provide the lift and tilt function in combination with a leg rest and/or reclining function. Those chairs which do provide such a combination of multi-positional functions generally require the use of multiple motors for driving (i.e., pushing) the separate linkages which results in extremely large and expensive chair units. In addition, most power-assisted chairs incorporate a drive mechanism which employs both a power "drive" function (i.e., for extending the leg rest, lifting the chair, and reclining the chair) and a power "return" function for returning the chair to the normal seated position.

SUMMARY OF THE INVENTION

It is a purpose of this invention to provide a low profile power-assisted drive mechanism that is reliable and efficient in operation, durable, and relatively compact and simple in construction, and which is adapted to be used with upholstered recliner chairs as well as other chairs.

It is also a purpose of the invention to provide a power-assisted drive mechanism confined with the base assembly of the chair which in the normal seating position has the outer appearance of an ordinary chair.

Another purpose of the invention is to provide a lift base assembly for chairs that is driven by an electric motor and which includes means to disable the motor if the chair is in an improper condition or if an obstruction is encountered during movement of the assembly.

It is another purpose of the present invention to provide a single power-assisted linear actuation drive mechanism for selectively actuating a chair reclining linkage assembly and a leg rest linkage assembly, in addition to raising, lowering and tilting the chair on the lift base assembly.

It is still another object of the present invention to provide spring-biased return means for substantially reducing the potential for damage to the drive mechanism due to an obstruction encountered when the seat occupant attempts to return the chair to its normal seating position.

A base assembly according to a preferred form of the invention comprises a stationary bottom frame and a movable upper frame to which a chair may be secured. A motor operated lift and tilt linkage mechanism moves the upper frame and the chair. The motor-operated linkage mechanism nests inside of the frames and the bottom of the chair, so that it is hidden when the chair is in the normal seating position. Operation of the motor cause the lift and tilt linkage mechanism to raise or lower the upper frame under the control of a hand-operated switch which may be actuated by a person using the chair.

More particularly, the motor-operated lift and tilt linkage mechanism of the present invention includes a front and lower H-shaped lift bar that is pivoted to a central portion of the lower frame and to a front portion of the upper frame. It also includes a rear and upper U-shaped tilt bar that is pivoted to a rear portion of the lower frame and a front portion of the upper frame. An electric motor, which drives the lift and tilt linkage mechanism, is pivotably secured to the rear of the lower frame and has a rotary power screw which extends through a nut that is pivotally attached to an upstanding bracket on the cross bar of the H-shaped lift bar. With this arrangement, rotation of the screw in one direction pulls the nut rearwardly for raising the lift bar and tilt bar for elevating and tilting the upper frame. The weight of the chair and its occupant act in opposition to the rearward lifting movement of the nut. This opposition puts the screw shaft in tension and, as compared with compressive loads associated with most conventional lift shaft designs, reduces the likelihood of shaft distortion for promoting improved reliability, durability and more efficient performance of the lift assembly.

In a preferred form, the power-assisted linear actuation drive mechanism of the present invention includes a modified nut or "cam guide" which is linearly moveable upon rotation of the power screw for selectively actuating the lift and tilt linkage mechanism for causing forward lifting and tilting movement of the chair when the motor is operated in a first direction. Rotation of the screw shaft in a second opposite direction acts to lower the chair to the normal seating position. Continued rotation in the second direction causes sequential operative extension of the leg rest assembly followed by angular reclining movement of the chair. This sequential operation of the leg rest assembly and the reclining linkage are independent and may be easily disabled to selectively eliminate either of the features.

Other features and advantages of the present invention will become apparent upon consideration of the drawings and the description set forth hereinafter.

DESCRIPTION OF THE DRAWINGS

FIG. 3 is a somewhat schematic perspective view of the lift base assembly of FIGS. 1 and 2 taken from the front with the chair removed and the base in the seated or down position;

FIG. 4 is a somewhat schematic perspective view of the lift base assembly of FIG. 3 taken from the rear with the chair removed and the base in the fully extended or lift position;

DETAILED DESCRIPTION OF THE EMBODIMENT OF THE INVENTION

Figure 1:
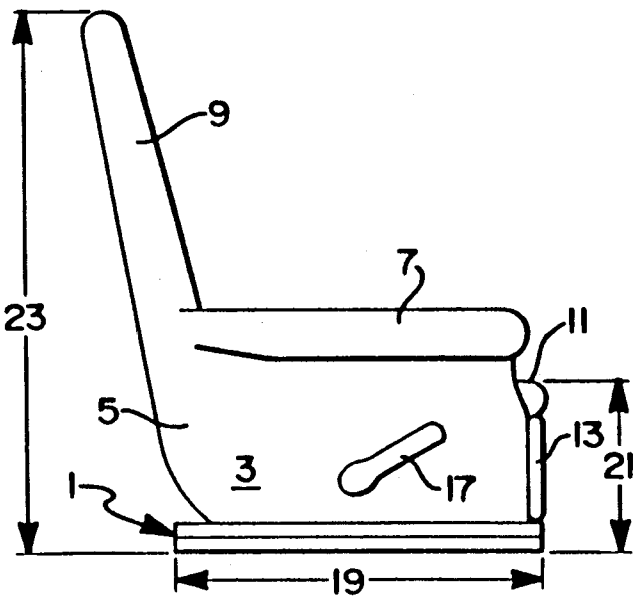
FIG. 1 is a diagrammatic side elevation of a reclinable upholstered chair, with extendable footrest, in seated position mounted on a lift base assembly embodying the invention.
Figure 2:
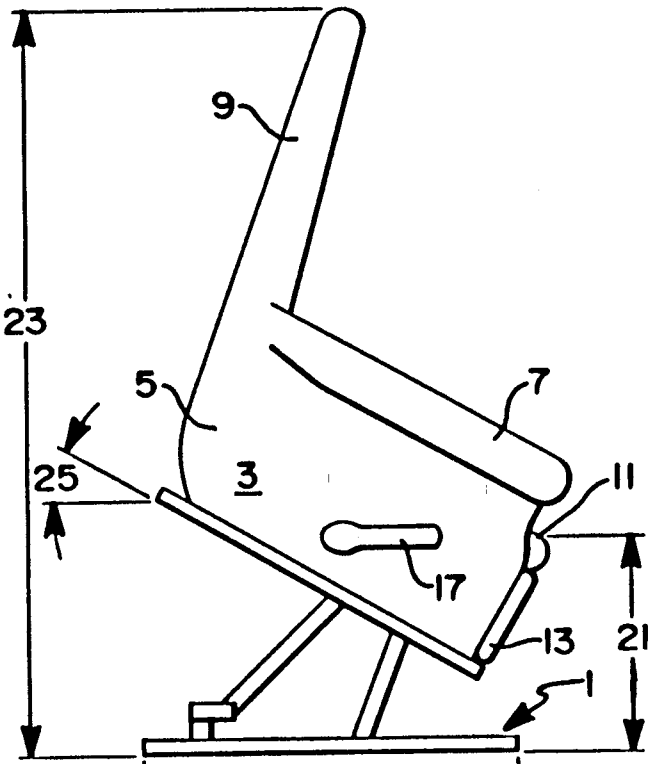
FIG. 2 is a view similar to FIG. 1, but showing the lift base in fully extended position, wherein it has lifted the rear of the chair and has, thereby, tilted the chair, parts of the operating mechanism being omitted for clarity.

A lift base assembly 1, according to the present invention, is shown in FIG. 1 supporting an upholstered chair 3 in a normal seated position. In FIG. 2 it is shown lifting chair 3 to a tilted position that makes it easier for a person to enter or leave the chair. Any of a wide variety of chair constructions can be used with base assembly 1. The well-known chair sold by the assignee hereof under the registered trademark RECLINA-REST is an example of one that can be mounted on the base 1 and it is shown very schematically in the drawings. U.S. Pat. No. 4,367,895, issued Jan. 11, 1983, entitled Reclinable Chair, shows many structural details of the RECLINA-REST chair. Chair 3 has a frame 5 with side arms 7, a seat assembly 8 defined by a seat back 9 that may recline in response to pressure from the back of an occupant and a seat portion 11 that moves simultaneously with seat back 9. Chair 3 also includes an extensible leg rest assembly 13. Leg rest assembly 13 may be manually operated through a mechanism (not shown herein but shown in U.S. Pat. No. 4,367,895) by rotation of a square cross shaft 15 (FIG. 5) that extends between the opposite sides of chair frame 5 via an external handle 17 located below arm rest 7 where it can be easily reached by a person occupying the chair.

In the embodiment shown, the fore and aft length 19 of base 1 is about $28\frac{7}{8}$ inches in the seated position of FIG. 1 and in the fully extended position of FIG. 2. With the particular chair 3 selected as an example, the height 21 of seat 11 above the floor is about 17 inches in the seated position of FIG. 1 and about 18 inches in the fully elevated position of FIG. 2. Normal height 21 for the chair 3 in the absence of base 1 would be about 15 inches. The overall height 23 of chair 3 in the seated position of FIG. 1 is about 41 inches and in the fully extended position of FIG. 2 it is about $55\frac{1}{2}$ inches. The angle of forward tilt 25 in the fully extended position of FIG. 2 is preferably about 29 degrees. It will be appreciated that these dimensions are merely exemplary in nature and are not intended to limit the present invention.

Base assembly 1 has a stationary, rectangular, bottom frame member 31 that rests on the floor and a movable, rectangular, upper frame member 33 on which chair 3 is removably but securely attached by suitable fasteners (not shown). Bottom frame member 31 includes wooden left and right hand side members 35 and 37, respectively, and these are rigid with a wooden front cross member 39. Side members 35 and 37 may have suitable pads 41 (FIG. 5) on the bottom to actually engage the floor.

Upper frame member 33 has wooden left and right hand side members 45 and 47, respectively, and these are rigid with a wooden rear cross member 49. Soft rubber-like pads 50 (FIG. 6) on the bottoms of upper side members 45 and 47 help transfer vertical chair loads into bottom side member 35 and 37 in the seated position of chair 3. The wooden outer portions of base assembly 1 give it the appearance of an ordinary chair base. The lift mechanism to be described nests inside of the wooden frame members and the bottom of chair 3 and, as indicated above, base assembly 1 is of low profile and increases the seat height by only about 2 inches.

Figure 6:
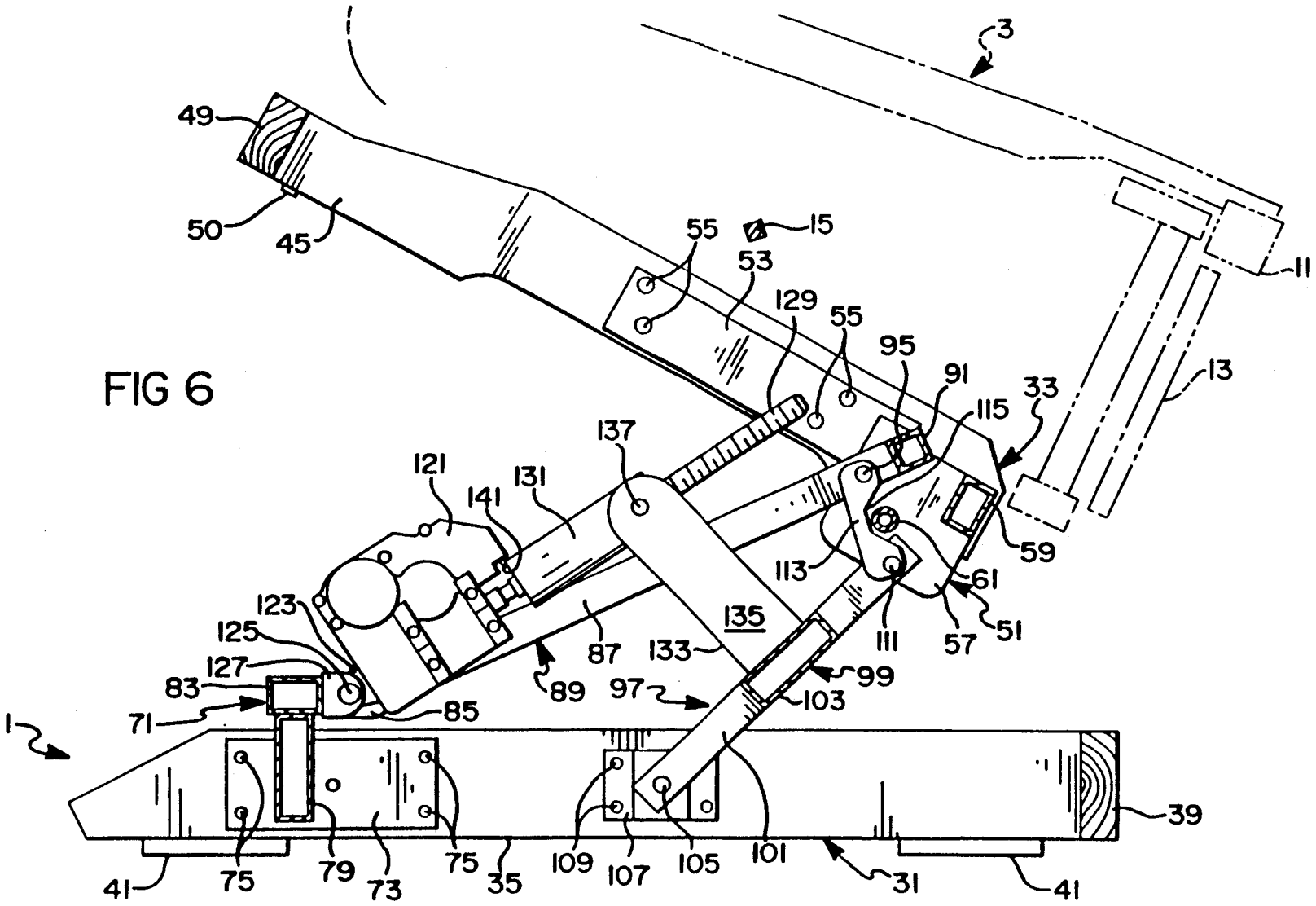
FIG. 6 is a vertical section through the base assembly of FIG. 4 but on an enlarged scale.

The front of upper frame member 33 is reinforced by a U-shaped metal pivot bracket 51. This has metal side plates 53 that are securely affixed to the inside faces of wooden side members 45 and 47 as indicated at 55. The front ends of side plates 53 are rigid with reinforcements and pivot plates 57 which extend below wooden side members 45 and 47 into the confines of lower frame 31 as seen in FIG. 6. Metal pivot bracket 51 includes a rectangular tube 59 that is a front cross piece extending between pivot plates 57 on opposite sides and made rigid with them, as by welding. A round metal tubular cross bracing piece 61 located somewhat below and to the rear of cross piece 59 also extends between pivot plates 57 and is made rigid with them, as by welding.

The rear of lower frame member 31 is reinforced by a transverse metal pivot bracket member 71 that includes metal side plates 73 that are securely affixed to the inside faces of wooden side members 35 and 37 a indicated at 75. Pivot bracket 71 also includes a rectangular tube 79 that is a rear cross piece extending between plates 73 on opposite sides and made rigid with them, as by welding and gussets 81 (FIG. 4). Another transverse rectangular tube 83 is seated on top of tube 79 and is made rigid with it, as by welding. Tubes 79 and 83 form a T-shaped load carrying component of lift base assembly 1. The height of tube 79 is such that tube 83 is located within the confines of upper frame 33.

Top tube 83 terminates at each end a slight distance inwardly from side plates 73. At each end, i.e., adjacent side legs 45 and 47, it has a U-shaped bracket 85 rigidly affixed to it, as by welding. These receive the rear ends of side legs 87 of a U-shaped upper tilt bar member 89. Side legs 87 are formed of square metal tubing and at their front ends they are rigidly affixed, as by welding, to opposite ends of a front cross piece 91, also a square metal tube. The rear ends of upper tilt bar side legs 87 that fit inside U-shaped brackets 85 on lower frame member 31 are pivotally attached to the opposite sides of the brackets as indicated at 93. As seen best in FIG. 5, the height of combined tubes 79 and 83 is such that side legs 87 are substantially horizontal when lift assembly 1 is in the fully lowered or seated position. The upper or front ends of side legs 87 are pivotally attached to pivot plates 57 on the front of upper frame member 33 as indicated at 95.

Tilt bar member 89 is a part of lift and tilt linkage mechanism 97 provided for operating base lift assembly 1. This mechanism also includes a lower lift bar member 99 that is pivoted at its rear end to a central portion of lower frame member 31 and at its upper end to pivot plates 57 of the upper frame member 33. Lower lift bar member 99 is substantially H-shaped and has left and right hand side legs 101 that are spaced apart the same amount as side legs 87 of the upper tilt bar 89 and are also formed of square metal tubing of the same cross section whereby legs 101 are coplanar with legs 87, though substantially shorter in length. A rectangular metal tube 103, similar to tube 79, extends transversely between side legs 101 and its opposite ends are made rigid with them, as by welding, at central portions of legs 101 as seen best in FIG. 6. The lower and rear ends of side legs 101 are pivotally attached at pivot 105 to brackets 107 that are rigidly affixed to the inside faces of side legs 35 and 37, as indicated at 109. The upper and front ends of legs 101 are pivotally attached to lower portions of the square pivot plates 57 as indicated at pivot 111. Reinforcement bars 113 maintain parallelism of upper and lower pivots 95 and 111 and are connected at their upper and rear ends to pivot plates 57 by way of pivots 95 and at their lower and front ends to pivot plates 57 by way of pivots 111. The bars 113 are cutout at 115 so that they can pass close to the rear of round cross brace tube 61.

Figure 5:
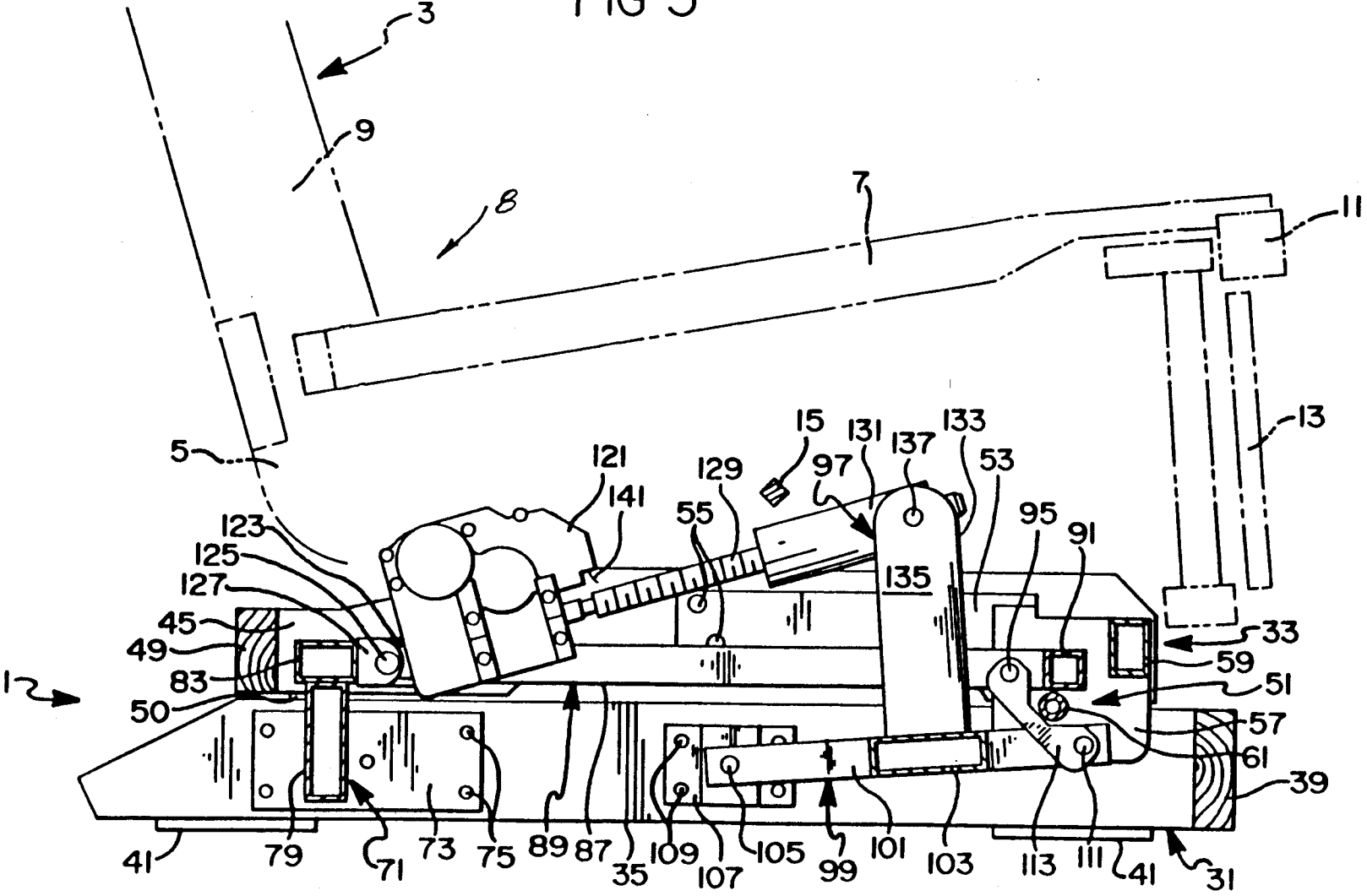
FIG. 5 is a vertical section through the base assembly of FIG. 3 but on an enlarged scale.

As seen best in FIG. 5 the various parts of tilt bar 89 and lift bar 99, forming lift and tilt linkage mechanism 97, are confined within the rectangular upper and lower frames 33 and 31, respectively, when base assembly 1 is in the lowered or normal seating position. Thus, the lift and tilt mechanism is low profile and compact.

Power-assist means, such as an electric motor 121, is connected to lower lift bar 99 for arcuately pivoting it up or down about pivots 105 and, thereby for operatively driving lift linkage mechanism 97. Motor 121 has a rigid rearwardly extending flange 123 which fits between and is pivotally attached at pivot 125 to the two sides of a U-shaped pivot bracket 127 that is welded to a central portion of top cross piece 83 of pivot bracket member 71 of lower base member 31. Motor 121 is selectively operable for rotating a screw shaft 129 in either a first or second direction. Both motor 121 and its rotary screw shaft 129 can arcuately swing up and down in a generally vertical plane about pivot 125. Screw shaft 129 extends through and drives an internally threaded sleeve or nut 131 so that sleeve 131 moves forwardly or rearwardly along the length of shaft 129 upon rotation of shaft 129 in one of the first and second directions. The front end of sleeve 131 is located between side surfaces 133 of tall U-shaped pivot bracket 135 and is pivotally attached to them as indicated at pivots 137, the axis of pivot 137 being parallel to but between the axes of pivots 105 and 111. U-shaped bracket 135 is centrally located on top of cross piece 103 of lower lift bar 99 and is made rigid with it, as by welding. As seen best in FIG. 5, bracket 135 projects only a little above the confines of upper frame 33, within available space inside chair 3, thereby maintaining the compactness and low profile of lift base assembly 1.

Comparing FIGS. 5 and 6, or FIGS. 3 and 4, it will be seen that in the seating or lowered position of chair 3, sleeve 131 is positioned near the front or outer end of threaded rotary screw shaft 129. Lifting of chair 3 is accomplished by energizing motor 121 to rotate screw shaft 129 in a direction that draws sleeve 131 toward the motor. This pulls pivot 137 rearwardly for causing lift bar member 99 to pivot upwardly about pivots 105. This upward pivotal movement is transmitted through pivots 111 at the front ends of lift bar member 99 for lifting of upper frame member 33. The path of the "lifting" movement is determined by lower lift bar side legs 101 and, also, by the longer upper tilt bar side legs 87. Front pivots 95 on upper frame 33 lift the front ends of side legs 87 which, therefore, pivot upwardly about their rear pivot connections 93 to lower frame member 31. Upper tilt arm 89 has a larger vertical component of travel during lifting than does lower lift bar member 99. Therefore, the rear end of chair 3 is "tilted" upwardly about pivots 111 in amounts proportional to the amount of lift. As previously indicated (FIG. 2), a chair entry and exit angle 25 of about 29 degrees is preferable. This is determined by contact of the rear end of sleeve 131 with a limit switch trigger 141 provided on or near motor 121 which opens the electrical circuit and stops motor 121. To lower chair 3, rotation of screw shaft 129 is simply reversed.

Motor 121 is preferably of a type that has means to sense a change in the state of force on linkage system 97 and to disable motor 121 in response to such a change. A motor of this type is sold by Maxwell Products, Inc. of Cerritos, Calif. and is described in U.S. Pat. No. 4,407,030, issued Oct. 4, 1983, entitled "Safety Device for an Adjustable Bed". It will be seen that in the present construction, the weight of chair 3 and an occupant of the chair will place a downward force on pivots 111 which tend to apply a forward force on pivots 137, thus putting screw shaft 129 in tension. If a foreign object or resistance is encountered by upper frame member 33 as it is being lowered, there will be a change in the tension load on screw shaft 129 since the effect of the obstruction will be to apply an opposite load (i.e. compression) to the screw. Preferably, motor 121 has means incorporated in its assembly to sense this change of state and disable the motor until the obstruction is removed. When upper frame 33 is lowered to the degree that it contacts lower frame 31 by way of pads 50, motor 121 will sense the change in resistance and be shut off.

Figures 7, 7A:
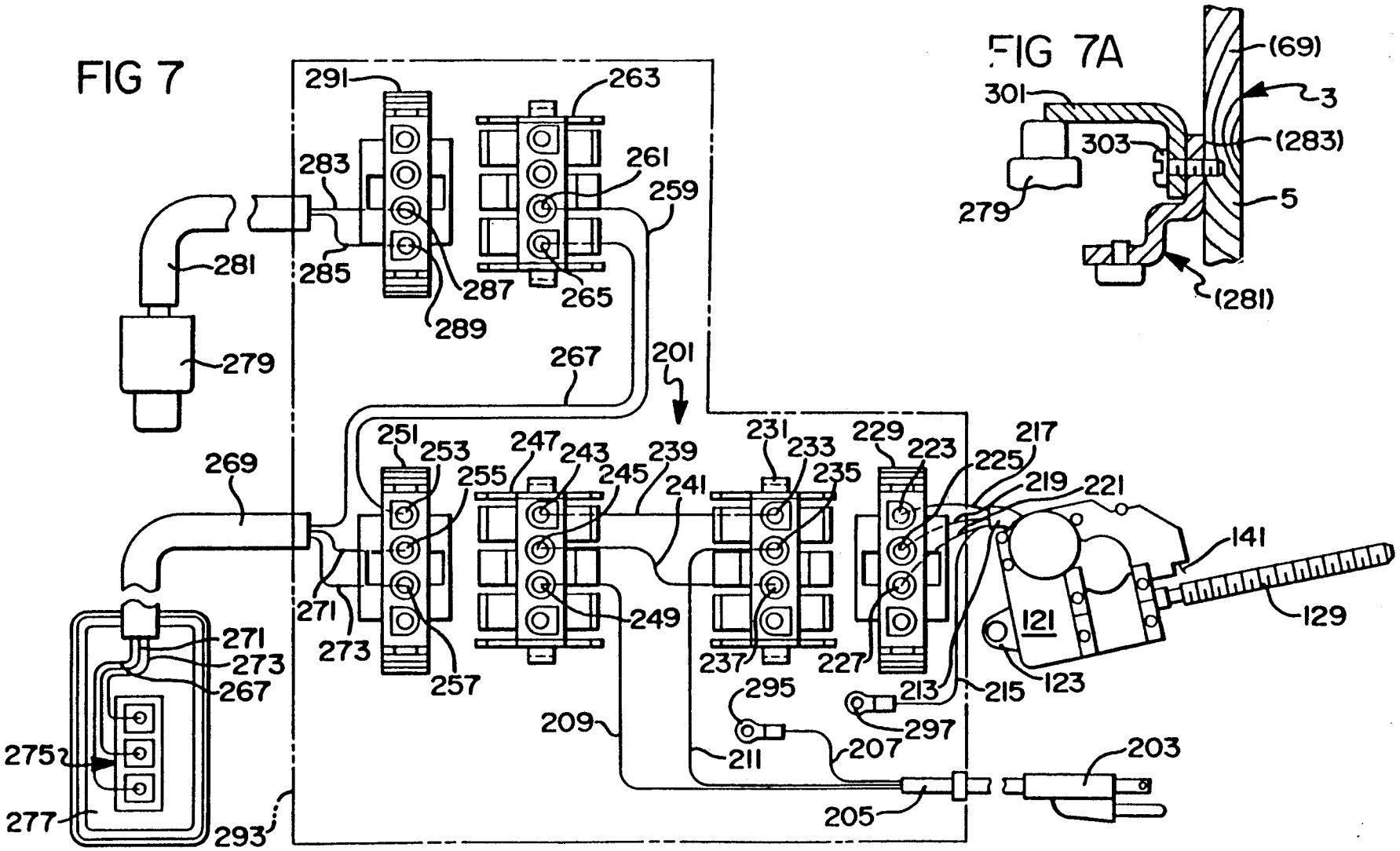
FIG. 7 is a wiring diagram for the assembly.
FIG. 7A is a view showing operation of the stop switch by the chair.

Referring to FIG. 7, the electrical control system 201 for motor 121 is shown to preferably include a three-prong grounding attachment plug 203 which fits into a grounding-type electrical receptacle (not shown) in the general proximity to where base assembly 1 is used for providing electrical current to operate the lift assembly. Plug 203 has an insulated cable or power cord 205 of suitable length containing a grounding conductor 207 and two current carrying conductors 209 and 211.

Motor 121 has an insulated power cord 213 which contains a grounding conductor 215 and three current carrying conductors 217, 219 and 221. The three current carrying conductors 217, 219 and 221 are connected to terminals 223, 225 and 227, respectively, of a male socket 229. Male socket 229 mates with female socket 231 so that male socket terminals 223, 225 and 227 are electrically connected to female socket terminals 233, 235 and 237, respectively. Current carrying conductor 211 of power cord 205 is connected to female socket terminal 235. The other terminals 233 and 237 of female socket terminal 235 are connected by conductors 239 and 241, respectively, to terminals 243 and 245, respectively, of a second female socket 247. A third terminal 249 of female socket 247 is connected to current carrying conductor 209 of power cord 205.

Socket 247 mates with male socket 251 so that male socket terminals 253, 255 and 257 are electrically connected to terminals 243, 245 and 249, respectively, of female socket 247. Terminal 253 of male socket 251 is connected by conductor 259 to terminal 261 of a third female socket 263. A second terminal 265 of socket 263 is connected to conductor 267 contained in hand control cord 269. Hand control cord 269, also, contains conductor 271 which is electrically connected to terminal 255 of male socket 251 and conductor 273 which is electrically connected to terminal 257 of male socket 251.

Hand control cord 269 terminates in a hand operated switch 275 housed within switch housing 277 that may be mounted to a side arm 7 of chair frame 5 or, alternatively, held and operated by a person using the chair 3. Preferably, when switch 275 is operated to connect conductors 271 and 273 electrical power is supplied to motor 121 to rotate screw shaft 129 in a direction to cause chair 3 to lower. When switch 275 is operated to connect conductors 271 and 267 power is supplied to rotate screw shaft 129 in the opposite direction for elevating chair 3 provided that the shut-off switch 279 is made or closed.

Shut-off switch 279 has a cord 281 containing current carrying conductors 283 and 285. Conductors 283 and 285 are electrically connected to terminals 287 and 289, respectively, of a male socket 291. Socket 291 mates with female socket 263 to electrically connect its terminals 287 and 289 to terminals 261 and 265, respectively, of the female socket.

The sockets 229, 231, 243, 251, 263 and 291 are preferably housed within a junction box 293 that may be rigidly secured (not shown) to cross piece 79 at the rear of lower frame member 31. The grounding wires 207 and 215 have terminals 295 and 297, respectively that may be connected (not shown) to the metal box.

Referring to FIG. 7A, the reference numbers in parentheses (i.e., 69, 281 and 283) are reference numbers used in the aforementioned U.S. Pat. No. 4,367,895 (see FIG. 6 of the patent) to designate certain structural features of the chair shown in that patent. As already indicated, chair 3, herein, may embody construction features shown in the patent (though the tracks 29 and related parts providing fore and aft movement responsive to back recline will be omitted in chair 3). A feature of chair 3 and the chair in the patent is that chair frame 5 tilts to raise the front edge whenever leg rest assembly 13 is moved away from its stowed position, shown herein, and/or whenever seat back 9 is reclined from its upright position shown herein. Thus, angular tilt of chair frame 5 signifies that leg rest assembly 13 is at least partially elevated and/or seat back 9 is at least partially reclined. Reference number (69) in the patent designates a front vertical post in chair frame 5 located approximately midway between the left and right sides of the chair. It will move up due to tilt of chair frame 5. Thus, as show in FIG. 7A, an angle shaped bracket 301 may be secured by screw 303 to post (69) in such a position that it engages and makes stop switch 279 when chair 3 is in its fully upright position with leg rest assembly 13 in its fully retracted position. As seen from the circuit diagram of FIG. 7, if stop switch 279 and switch 275 are pressed to interconnect conductors 267 and 271, current is able to flow through the various conductors to rotate lift motor 121. On the other hand, if switch 279 is open due to bracket 301 being raised by tilt of chair frame 5, current cannot reach motor 121. It is preferred that this control by switch 279 be applied to the lift mode so that chair 3 and upper frame 33 will not elevate if seat back 9 is reclined or leg rest assembly 13 is elevated. On the other hand, if switch 275 is pressed to interconnect conductors 273 and 271, current is able to flow through various conductors to energize lift motor 121 for rotating screw shaft 129 in a direction to lower chair 3.

In the lowered position of lift base assembly 1, the wooden outer parts of lower and upper frames 31 and 33, respectively, give the appearance of an ordinary base for chair 3. The compact, low profile of electric motor 121 and lift linkage mechanism 97 enable it to fit for the most part within the confines of the upper and lower frames, inside the bottom of chair 3, and below cross shaft 15.

When circuit 201 is activated by way of switch 275 to elevate upper frame 33, lift motor 121 is energized to rotate screw shaft 129 in a direction to pull nut 131 toward the rear of lift base assembly 1 and motor 121. Such movement of nut 131 pulls its pivot 137 rearwardly so as to pull the top of bracket 135. Since bracket 135 is secured to the sturdy H-shaped lift bar member 99 such movement of nut 131 causes lift bar member 99 to pivot upwardly about pivots 105 on lower frame 31. This is accompanied by upward pivoting of motor 121 for moving screw shaft 129 upwardly through an arcuate path. The upward movement of lift bar member 99 raises pivots 111 which, thereby, raises the front end of upper frame 33. However, the sturdy U-shaped tilt bar member 89 is also pivoted at pivot 91 to side plates 57 and as these pivots are elevated, tilt bar member 89 pivots upwardly about its pivots 93 with respect to rear cross piece 71 of lower frame 31. Since tilt bar member 89 is longer than lift bar member 99, it forces upper frame 33 to tilt about the axis of lift member pivots 111, thereby raising the rear of upper frame 33 so that upper frame 33 goes from a substantially horizontal lowered position to an inclined elevated position. When nut 131 reaches limit switch 141, motor 121 is stopped for holding chair 3 in the lifted positions of FIGS. 2 and 6 in which it is easier for a person to be seated or to leave chair 3.

When it is desired to lower chair 3, circuit 201 is activated by way of switch 275 to lower upper frame 33. Lift motor 121 is energized to rotate screw shaft 129 in an opposite direction to move nut 131 forwardly away from motor 121. This will produce pivotable action of lift linkage mechanism 97 which is the reverse of that previously described. When upper frame 33 engages lower frame 31, or if an obstruction is encountered before complete lowering, motor 121 will sense the change in load on screw shaft 129 and shut off (i.e., de-energized) as previously described.

During both elevation and lowering, upper frame 33 can be stopped and retained in any desired position by discontinuing actuation of switch 275. As can be seen, the sturdy, rugged construction of lift linkage mechanism 97 enables it to solidly support the weight of a chair and occupant with stability and durability Turning now to a multi-function chair 300 embodied in FIGS. 8 through 14, many of the components and sub-assembles are identical or substantially similar to that previously described with reference to the embodiment illustrated in FIGS. 1 through 7. More particularly, multi-function chair 300 embodies a power-assisted cam actuation drive mechanism 301 adapted for selective actuation of a reclining linkage assembly 303 and leg rest assembly 13 in addition to operation of lift linkage assembly 97'. In general, the power-assisted cam actuation drive mechanism 301 provides for sequentially actuating leg rest assembly 13 and the reclining linkage 303 utilizing a single motor 121' and a modified sleeve or nut, hereafter referred to as cam guide 302. More specifically, cam guide 302 is adapted to move linearly relative to screw shaft 129 for sequentially driving a leg rest follower assembly 304 and a recliner follower assembly 306 which, in turn, are operatively coupled to leg rest assembly 13 and reclining linkage 303, respectively. Thus, in the embodiment illustrated in FIGS. 8 through 14, identical reference numbers are used to identify substantially similar structure. As will be appreciated, the use of a single linear actuation drive system such as cam actuation drive mechanism 301 provides for selectively lifting and tilting chair 300 (via lift and tilt linkage 97'), extending and retracting leg rest assembly 13 (via leg rest follower assembly 304), and angularly moving seat back 9 and seat 11 of seat assembly 8 between an "upright" and a "reclined" position (via recliner follower assembly 306).

Figure 8A:
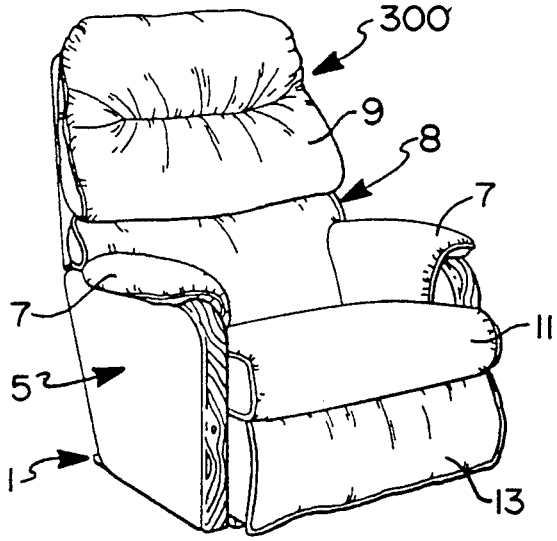
FIGS. 8A through 8D illustrate the various operative seating positions associated with selective actuation of a power-assisted cam actuation drive mechanism incorporated into a second embodiment of a multi-functional chair according to the present invention.
Figure 8B:
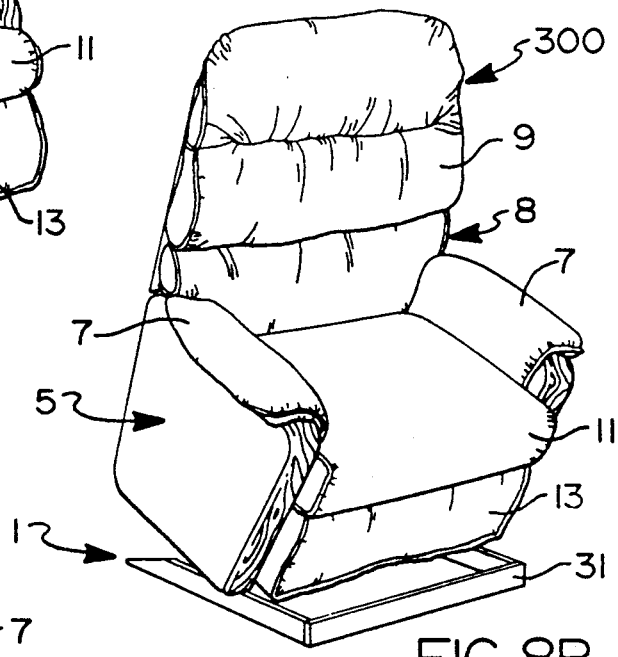
Figure 8C:
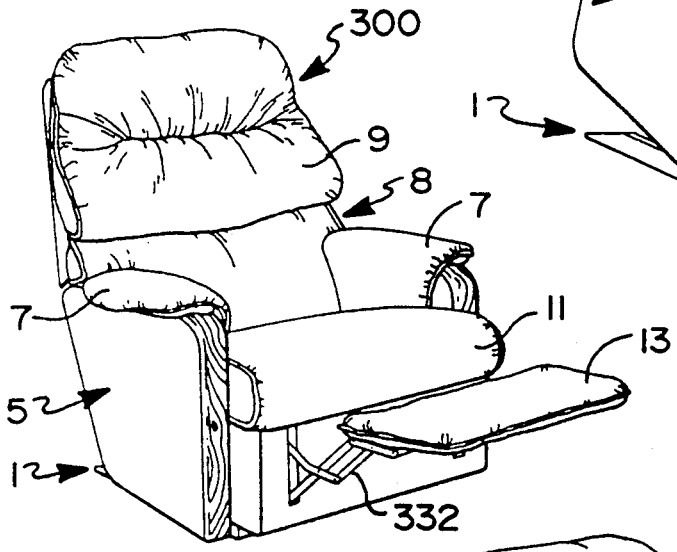
Figure 8D:
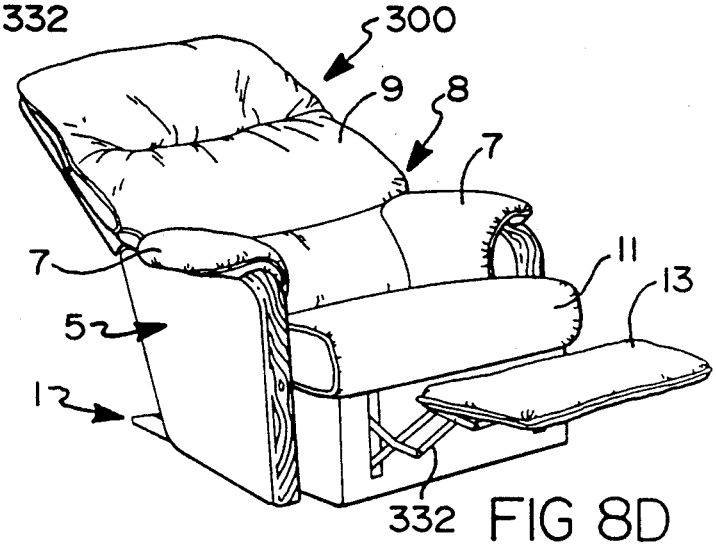

With particular reference to FIGS. 8A through 8D, various operative positions of multi-function chair 300 are illustrated. FIG. 8A shows upholstered chair 300 in a "normal" seated or "upright" position. FIG. 8B illustrates chair 300 "lifted" to a forward-tilted position upon actuation of lift and tilt mechanism 97' for making it easier for a person to enter or exit chair 300. FIG. 8C illustrates leg rest assembly 13 fully extended with chair 300 in an upright seating position. Finally, FIG. 8D illustrates chair 300 having seat assembly 8 angularly moved to a fully "reclined" position following extension of leg rest assembly 13.

As previously mentioned, chair 300 is preferably made up of several components and assemblies herebefore described and which include lift base assembly 1, chair frame 5, seat back 9, seat portion 11, leg rest assembly 13 and a modified lift and tilt mechanism 97'. Chair frame 5 has left and right side members 308 having rearwardly sloping uprights 312 with side members 308 being interconnected by a rear cross member 314 and front top and bottom transverse cross rails 316 and 318, respectively, which are joined together by side bracket plates 320. Side bracket plates 320 are secured to vertical uprights 322 located at the front end of chair frame 5. Chair frame 5 is mounted outside and generally on top of base lift assembly 1 and is pivotally secured thereto about a pivot 319 between a bracket 324 provided on an inner wall of side members 308 and a second bracket 323 secured to an upper surface of side members 45 and 47 of upper frame 33. A leg rest board or panel 330 is supported upon chair frame 5 by a pair of pantograph leg rest linkage assemblies 332 an example of which is clearly illustrated and described in the U.S. Pat. No. 3,588,170 to E. M. Knabusch et al., issued June 28, 1971 for "Motor-Operated Reclining Chair", the specification and drawings of which are expressly incorporated by reference herein. It is to be understood that pantograph linkages 332 are applied to both sides of chair frame 5 but since both are exactly alike, only one will be described herein in detail.

Figure 9:
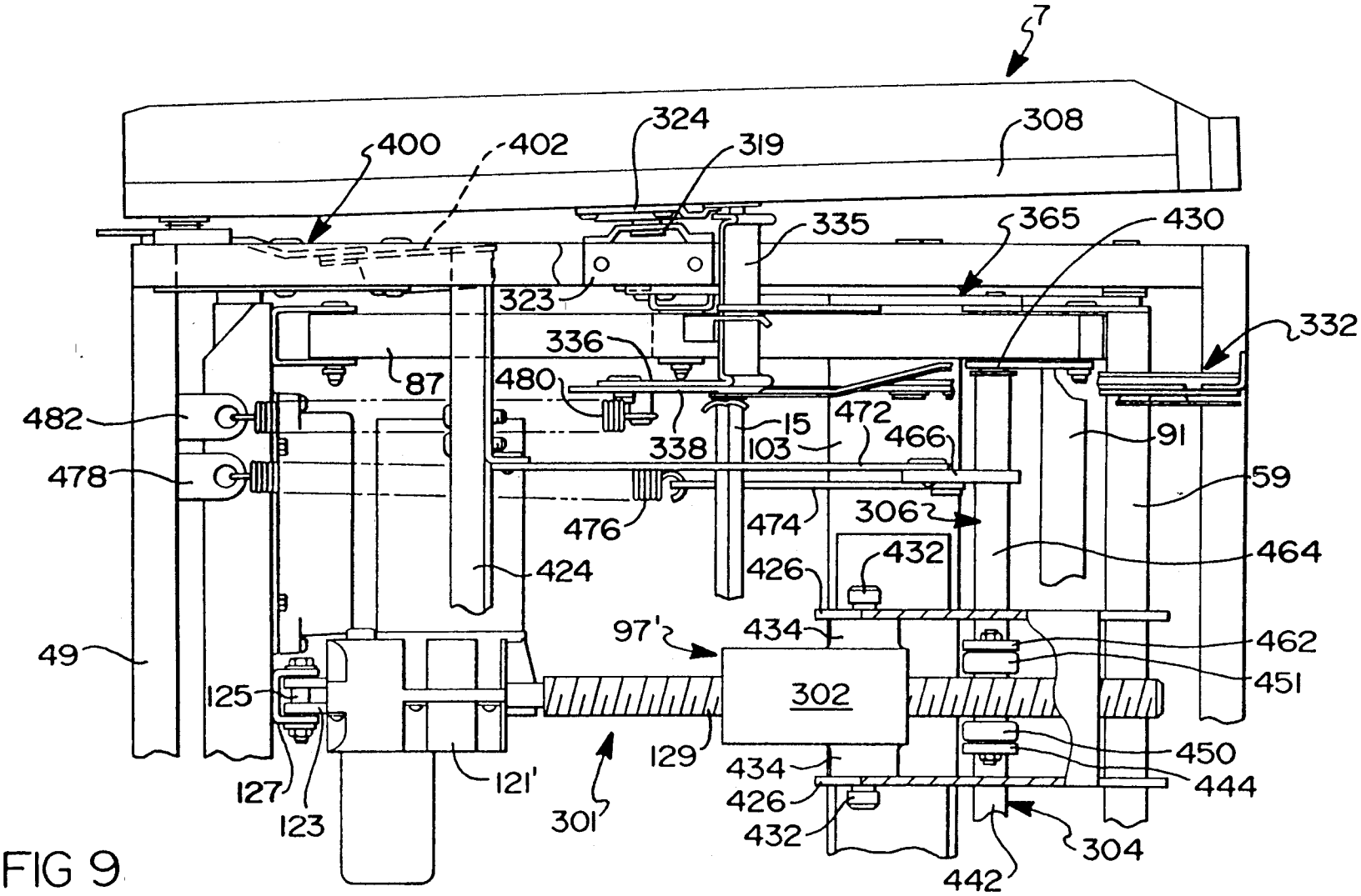
FIG. 9 is a plan view of the left-side portion of the chair frame, with upholstery removed, illustrating the various components of the power-assisted cam actuation drive mechanism which are provided for selectively operating the chair lift linkage mechanism, a reclining linkage assembly and a leg rest linkage assembly.

As best seen in FIG. 9, square drive shaft 15 extends transversely to chair frame 5 and is supported from inner walls of chair frame side members 308 for rotational movement. An L-shaped bracket 335 is coupled for rotation with drive shaft 15 and includes downturned operating arms 336. An actuating or long drive link 338 of pantograph linkage 332 is pivotally secured about a pivot 340 to a lower end of arm 336, with the opposite end of link 338 being pivotally secured about a pivot 342 to a link 344. Link 344 is pivotally secured about a pivot 346 to a link 348 which is pivotally secured about a pivot 350 to a mounting bracket 352, one of which is mounted near each lateral end of leg rest panel 330. A pivot 354 secures one end of link 356 to the opposite end of mounting bracket 352 while its opposite end is pivotally secured about a pivot 358 to a link 360 which is pivotally secured to a bracket 362 supported on top rail 316 of chair assembly 5 about a pivot 364. Link 356 is secured to link 344 by a pivot 366 and link 338 is joined to link 360 by a pivot 368. A brace or "spacing" link 370 having a central strengthening rib 372 is pivotally secured to at one end to bracket 362 about pivot 364 and is journally connected at its opposite end to square drive shaft 15. Brace links 370 prevent any substantial bending of the square drive shaft 15 through the operation of cam guide 302 when actuating leg rest assembly 13.

With continued reference to FIGS. 10 through 13, a reclining linkage assembly 303 is provided for causing reclining angular movement between seat frame 11 and seat back 9. Reclining linkage includes a front swing linkage assembly 365 and rear swing linkage 400. More particularly, front swing linkage 365 includes a pivot 328 associated with side plate bracket 320 which supports an S-shaped link 380, the lower end of which is pivotally secured about a pivot 382 to a first end of link 384. The opposite end of link 384 is pivotally connected at pivot 385 to a lower end of link 386 which, in turn, is pivotally secured about a pivot 388 associated with bracket 390 attached to a forward upper surface of side rails 45 of upper frame member 33. The upper end of link 386 is pivotally connected to one end of J-shaped toggle link 394 with the opposite end of J-shaped toggle link 394 being pivotably connected to L-shaped bracket 335 which is secured for rotation on square drive rod 15. The upper end of S-shaped links 380 are pivoted on pins 396 on left and right side rails 395 of seat frame 11. As will be described hereinafter in greater detail, the interaction between the various linkages associated with front swing linkage 365 cause rearward tilting of chair frame 5 about pivot 319 relative to base assembly 1 upon extension of leg rest assembly 13. More particularly, upon drive shaft 15 being driven to rotate in a counterclockwise direction (FIG. 10), link 386 pivots about pivot 388 on bracket 390 to cause link 384 to drive the front of chair frame 5 upwardly and rearwardly.

Also forming part of reclining linkage assembly 303 is a rear swing linkage 400 including a bracket 402 secured to each of seat frame side rails 395 near the rear end thereof. Bracket 402 has an upwardly extending rear portion 404 and a downwardly extending forward portion 406. An S-shaped link 408 is pivotally secured about a pivot 410 to upstanding rear portion 404 and a link 412 is pivotally secured about a pivot 414 to downwardly extending forward portion 406, the structure being somewhat similar to that illustrated and described in the above-mentioned U.S. Pat. No. 3,588,170.

An arm link 416 is secured to uprights 312 of chair frame 5 by screws, rivets or other reliable securing means. The upper ends of S-shaped links 408 are pivotably secured to arm links 416. Back frame 9 is mounted to the upper end of S-shaped links 408 for pivotal movement relative to uprights 312. With this arrangement, back frame 9 is supported for forward and rearward reclining movement. The lower end of S-shaped link 408 is pivotally secured about a pivot 420 to an offset link 422, the opposite end of which is coupled to a square tubular crossbar 424 and to which the opposite end of link 412 is pivotally secured. It is to be understood that similar linkages 412 and 422 on the opposite side of seat frame 9 are likewise secured to the opposite end of the crossbar 424. A spring member 425 is attached between an underside surface of side frames 395 of seat frame 11 and cross rail 314 of chair frame 5 for normally biasing rear swing linkage 400 toward its upright position (FIG. 10).

In accordance with the novel features encompassed in multi-function chair 300 shown in FIGS. 8 through 14, lift and tilt linkage mechanism 97, has been modified to include tall L-shaped pivot brackets 426, which are located on opposite sides of screw shaft 129 and rigidly secured to a top surface of cross piece 103 of lower lift bar 99, such as by bolts and/or welding. L-shaped pivot brackets 426 are spaced to permit cam guide 302 to move linearly (fore and aft) therebetween and include elongated slots 428. A torque tube 430 is provided which extends transversely between side legs 87 of U-shaped tilt bar member 89. Torque tube 430 is located in close proximity to front cross piece 91 for defining pivot point 95 and about which brackets 113 are pivotally secured. Guide pins 432 are fixed to opposite transversely extending boss portions 434 of cam guide 302 so as to project through slots 428. As noted, screw shaft 129 extends through and drives internally threaded cam guide 302 such that cam guide 302 moves forwardly or rearwardly along the length of screw shaft 129 upon selective energization of motor 121'.

Figure 10:
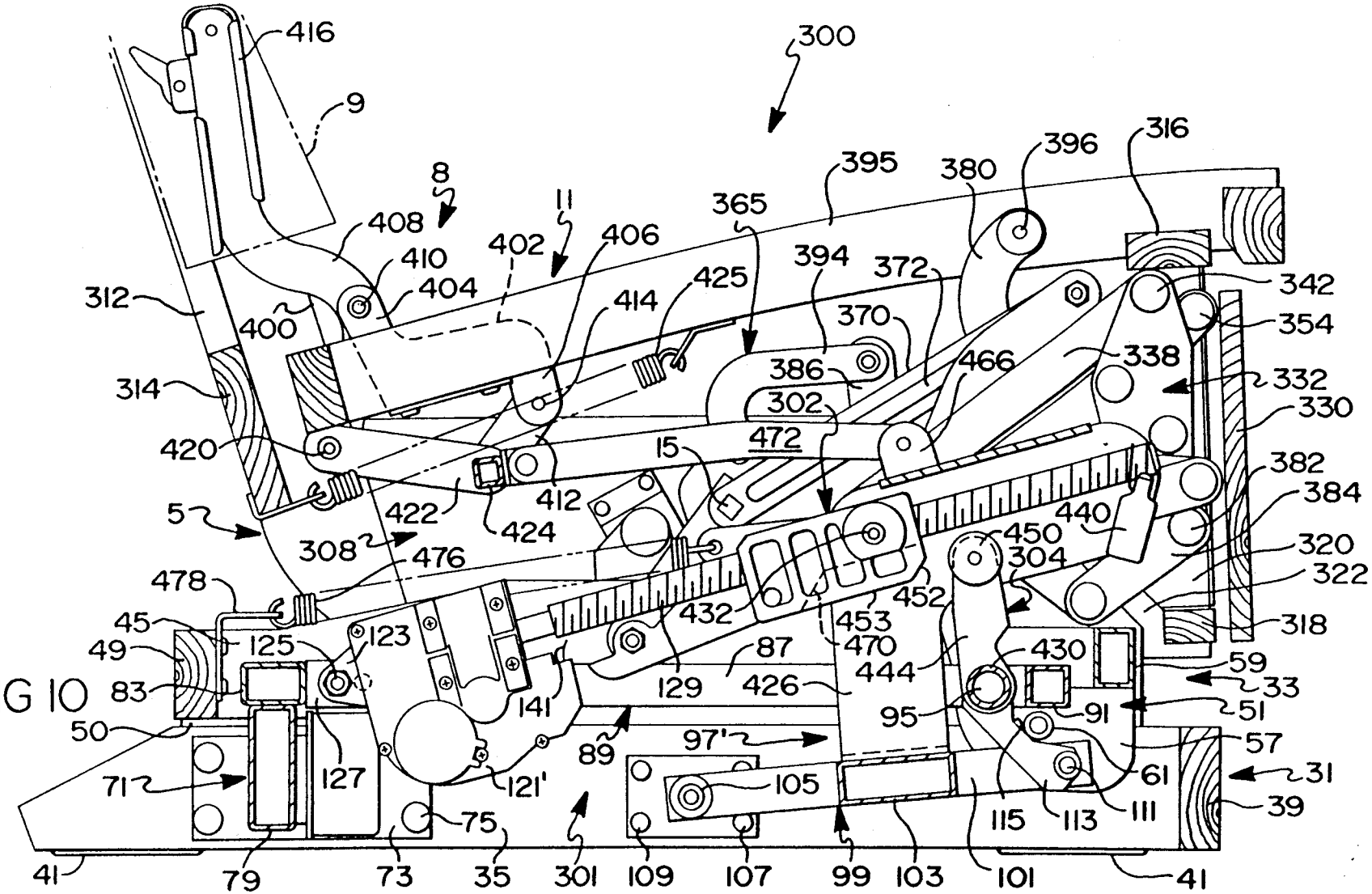
FIG. 10 is a vertical cross-sectional view, similar to FIG. 5, through the multi-functional chair of FIG. 8.
Figure 11:
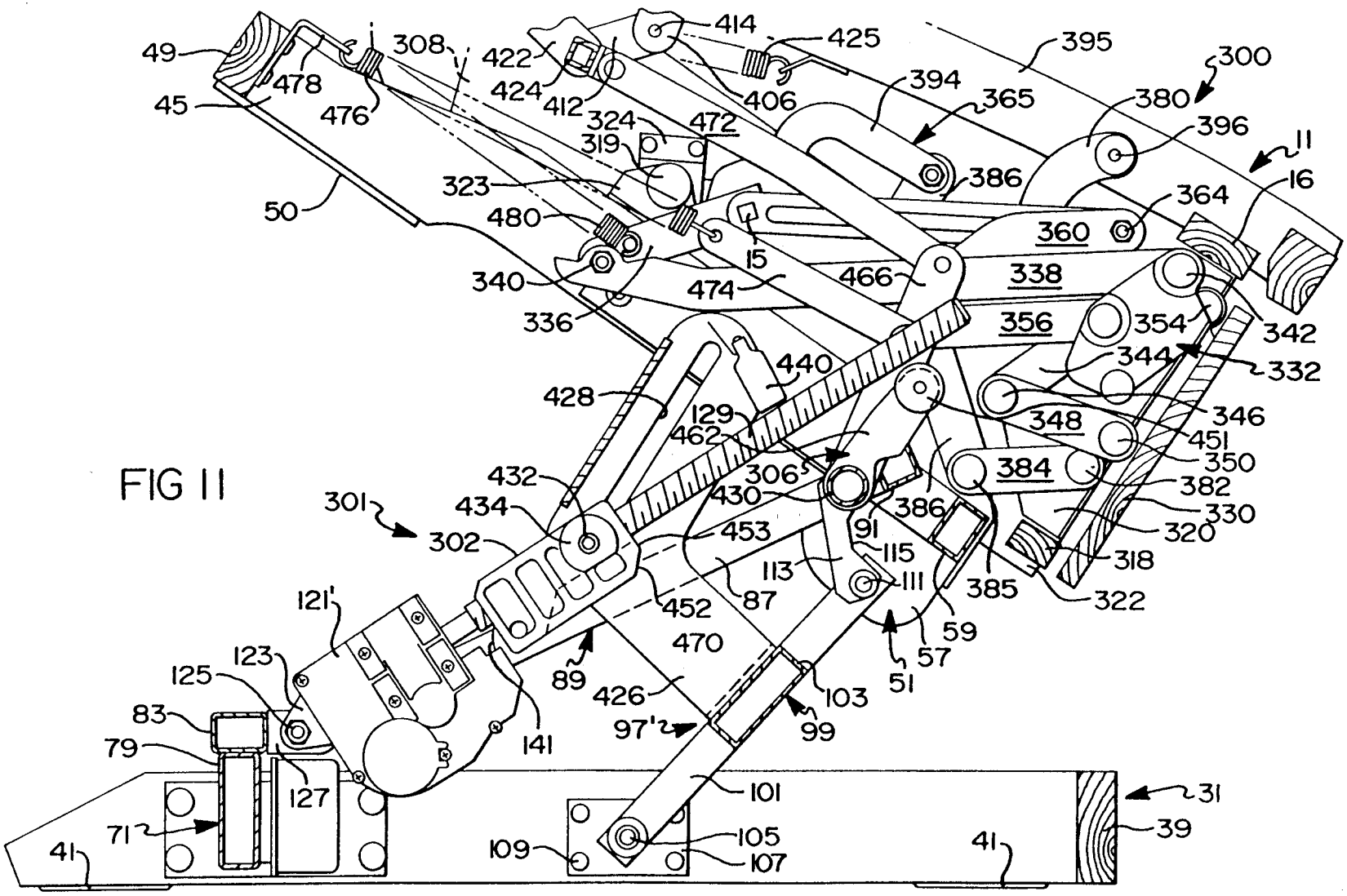
FIG. 11 is a vertical cross-sectional view, similar to FIG. 6, through the multi-functional assembly of FIG. 8.

As will be appreciated, and in particular reference to FIG. 10, when chair 300 in the "normal" seating (i.e., lowered and upright) position, cam guide 302 is positioned near a central portion of screw shaft 129. Lifting and tilting of chair 300 is accomplished by selectively energizing motor 121' to rotate shaft 129 in a direction that draws cam guide 302 rearwardly toward motor 121'. Following a slight amount of initial rotation of shaft 129, cam guide 302 moves rearwardly until pins 432 engage the rearward end stop surface of slots 428 such that continued rotation of screw shaft 129 causes lift bar member 99 to pivot upwardly about pivot 105 for moving chair frame 5 to the position shown in FIG. 11. Except for the modification described, the operation of lift linkage assembly 97' is substantially identical to that previously described herein.

Another feature of chair 300 of the present invention encompasses elimination of a "power pinch" condition upon a foreign object or resistances encountered by upper frame 33 as it is being lowered. As mentioned, motor 121 of the first embodiment incorporated internal means adapted to sense the change in loading on screw shaft 129 for disabling the motor. As such motor 121 was also adapted to shut off when upper frame 33 contacted lower frame 31. However, cam drive mechanism 301 is adapted to permit continued forward movement of cam guide 302 relative to screw shaft 129 when upper frame 33 is lowered into contact with lower frame 31 (FIG. 10) for selectively actuating leg rest assembly 13 and reclining linkage assembly 303. More particularly, the mechanical interaction of cam guide 302 with lift linkage assembly 97' is such that pins 432 are free to move forwardly in slots 428 when an obstruction is encountered upon lowering chair frame 5 for eliminating the "power pinch" condition.

With particular reference now to FIGS. 9 and 12 through 14, means are provided for selectively actuating leg rest assembly 13 and reclining linkage assembly 303 upon selective continued energization of motor 121'. More particularly, first follower assembly 304 is concentrically mounted for pivotable movement on a portion of torque tube 430. First follower assembly 304 is provided for operatively rotating drive rod 15 for causing power-assisted actuation of leg rest pantograph linkages 332. First follower assembly 304 includes a first tubular sleeve 442 concentrically supported on torque tube 430 to which is secured a first cam lever 444 and a first cam link 446. First cam lever 444 and first cam link 446 are rigidly secured to first tubular sleeve 442 such as by welding and a spacer bar 448 is provided therebetween for supplying additional rigidity. Attached to an upper end of first cam lever 446 is a follower member, such as nylon roller 450, adapted to rollingly engage a first cam surface 452 formed on an undersided surface of cam guide 302 and is generally adjacent to a front transverse end 453 thereof.

First cam link 446 is pivotally connected at its upper end to a first end of toggle link 454, the opposite end of which is connected to a drive link 456. Drive link 456 is coupled to drive shaft 15 for rotation therewith. As such, first follower assembly 304 is designed to interact with first cam surface 452 of cam guide 302 for selectively actuating leg rest linkages 332 by causing rotation of drive shaft 15. More particularly, as cam guide 302 moves forwardly on screw shaft 129, first roller 450 engages first cam surface such that first cam link 446 is forwardly pivoted on torque tube 430 for causing corresponding angular movement of drive shaft 15 which, in turn, causes pantograph linkages 332 to extend. Furthermore, a pair of left and right springs 480 are provided for interconnecting each pantograph linkages 332 to a bracket 482 rigidly supported from rear cross frame 49. Springs 480 are provided for biasing first follower assembly 304 rearwardly for returning leg rest assembly 13 to its retracted "stored" position once first cam surface 452 disengages follower 450 upon reversing the rotation of screw shaft 129.

Second follower assembly 306 is also installed concentrically about torque tube 430 and includes a second cam lever 462, a second tubular sleeve 464, a second cam link 466 and a second spacer bar 468. A second roller 451 is supported from second cam lever 462 and is adapted to rollingly engage a second cam surface 470 formed on the right half underside surface of cam guide 302. Second cam surface 470 is located sufficiently rearward of first cam surface 452 to permit full extension of leg rest assembly 13 prior to initiation of any reclining movement. This orientation of first cam surface 452 relative to second cam surface 470 is clearly illustrated in reference to FIG. 12. The upper end of second cam link 466 is pivotally connected to an attach link 472 provided for connecting second cam link 466 to tubular cross bar 424. As such, second cam surface 470 acts on second follower 451 of second follower assembly 306 for moving cross bar 424 forwardly upon forward movement of cam guide 302. Such movement of cross bar 424 causes corresponding movement of reclining linkage assembly 303 for moving chair 300 to the "reclined" position of FIG. 13.

One end of a spring link 474 is interconnected to second cam link 466 and the other end of spring link 474 supports one end of a spring member 476. The other end of spring member 476 is supported from a bracket 478 rigidly secured to cross rail 49 of upper frame 33. Spring 476 is provided for urging second cam link 466 and, in turn, second follower assembly 306 rearwardly so as to bias reclining linkage 303 and, in turn, the seat assembly toward the "upright" position. Therefore, second follower assembly 306 is also adapted to provide spring-biased return means.

In operation, when the hand control is selectively operated by the seat occupant to drive motor 121' in a first direction, chair 300 moves from the "normal" position shown in FIG. 8A to the forward "lifted" position shown in FIG. 8B. More particularly, rotation in this first direction causes cam guide 302 to move rearwardly toward motor 121, such that pins 432 engage the rear stop surfaces of slots 428 for pivoting lift and tilt linkage 97' in the manner heretofore described. As is apparent, selective actuation of switch 275 for reversing the rotation of screw shaft 129 in the second opposite direction causes chair assembly 300 to be lowered for returning to the normal seating position of FIG. 8A. However, in accordance with the teachings of the present invention, continued rotation of shaft 129 in the second direction causes continued forward movement of cam guide 302 relative to screw 129. Pins 432 move forwardly through slot 428 until the first cam surface 452 formed on the underside of cam guide 302 engages first roller 450 supported on first cam lever 442 of first follower assembly 304.

Figure 12:
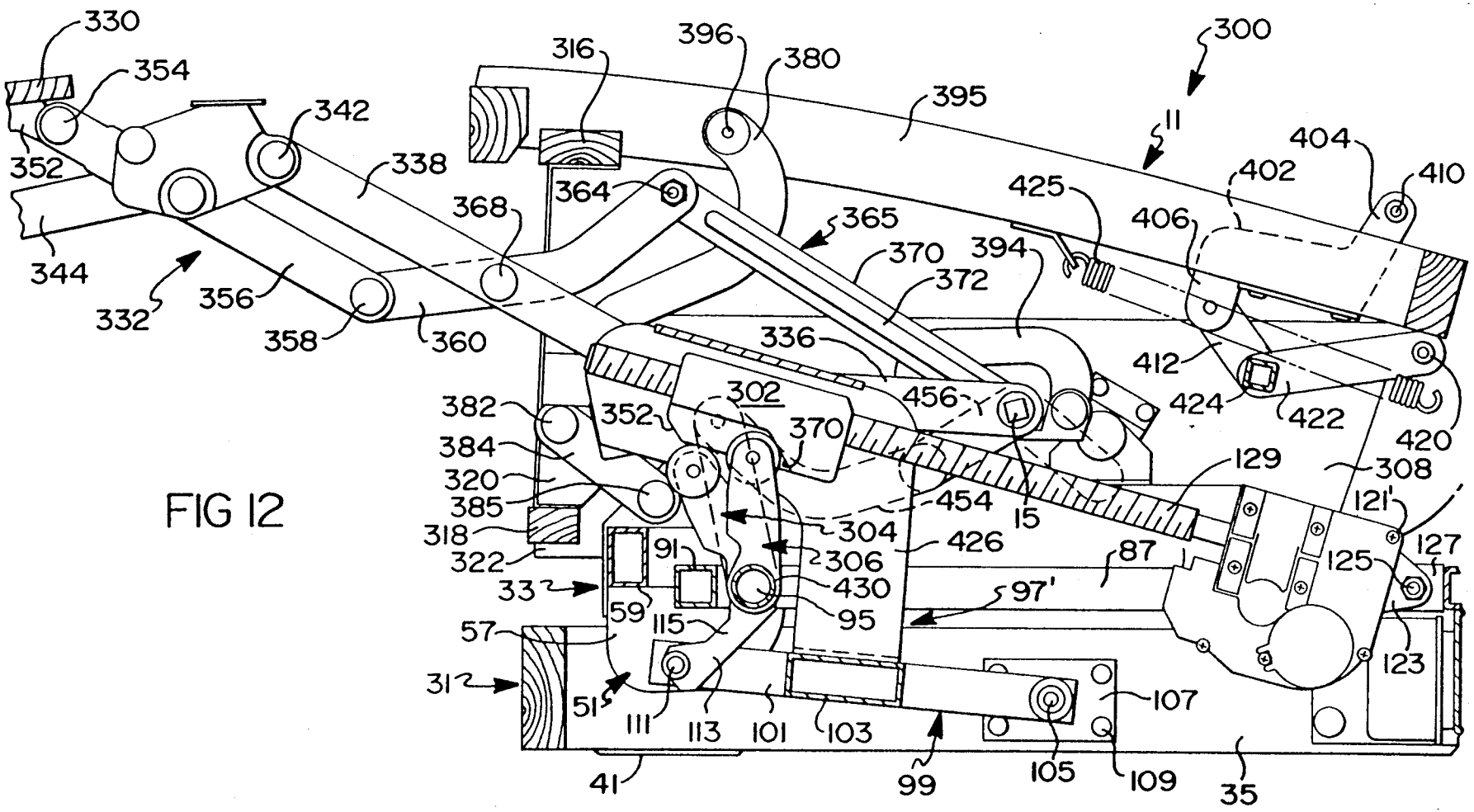
FIG. 12 is an opposite vertical cross-sectional view showing the leg rest linkage assembly in a fully extended position.

In comparing FIGS. 10 and 12, first roller 450 is shown in FIG. 10 in a neutral position of non-engagement with first cam surface 452 and, in FIG. 12 in a position of contact with respect to first cam surface 452 that corresponds to full extension of leg rest assembly 13. As such, it will be appreciated that forward movement of cam guide 302 pivotably drives first follower assembly 304 about torque tube 430 such that first cam link 446 drives toggle link 454 which, in turn, drives connector link 456 for rotating drive shaft 15. In this manner, pantograph leg rest linkages 332 are protracted to their extended position of FIG. 12. Such rotation of drive shaft 15 extends pantograph linkages 332 in a known manner.

Adjacent first cam surface 452 is a generally planar surface 453 which, upon full extension of leg rest assembly 13, first roller 450 continues to ride against upon continued forward movement of cam guide 302. This planar surface 453 permits continued forward movement of cam guide 302 without generating any additional rotation of drive shaft 15. Leg rest assembly 13 can be returned to its retracted position by simply reversing the rotation of screw shaft 129 for moving cam guide 302 rearwardly so as to permit springs 480 to rearwardly rotate first cam follower assembly 304. In this manner, the present invention includes spring-biased return means instead of power return typically associated with conventional power-assisted chair units. This is desirable in that this spring-biased return means generates a significantly reduced return force as compared to systems having a power return feature.

According to the present invention, upon full extension of leg rest assembly 13 via first cam surface 452 drivingly moving first follower assembly 304, continued forward movement of cam guide 302 causes engagement between second roller 451 of second follower assembly 306 and second cam surface 470 (See FIG. 13) for forwardly driving second cam link 466 which, in turn, forwardly drives (i.e. pulls) tubular cross bar 424 for reclining chair 300 in the manner described. Preferably, a slight amount of cam guide linear displacement along screw shaft 129 is provided between the end of the point of contact of first follower 450 and first cam surface 452 and the beginning of contact by second follower 451 and second cam surface 470 such that the seat occupant may fully extend leg rest assembly 13 without initiating reclining movement.

Figure 13:
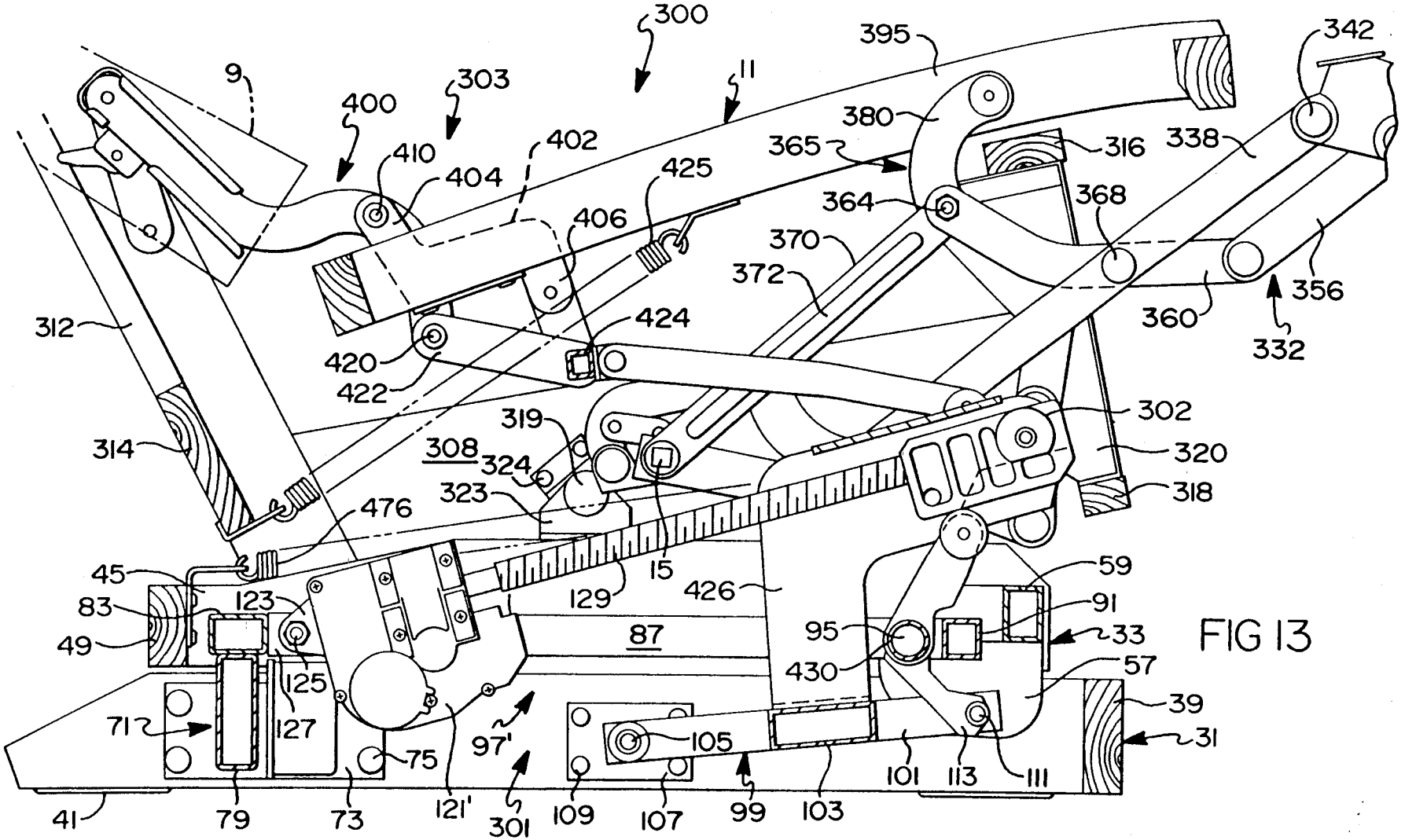
FIG. 13 is a vertical cross-sectional view illustrating the operative position of the reclining linkage following extension of the leg rest linkage assembly.
Figure 14:
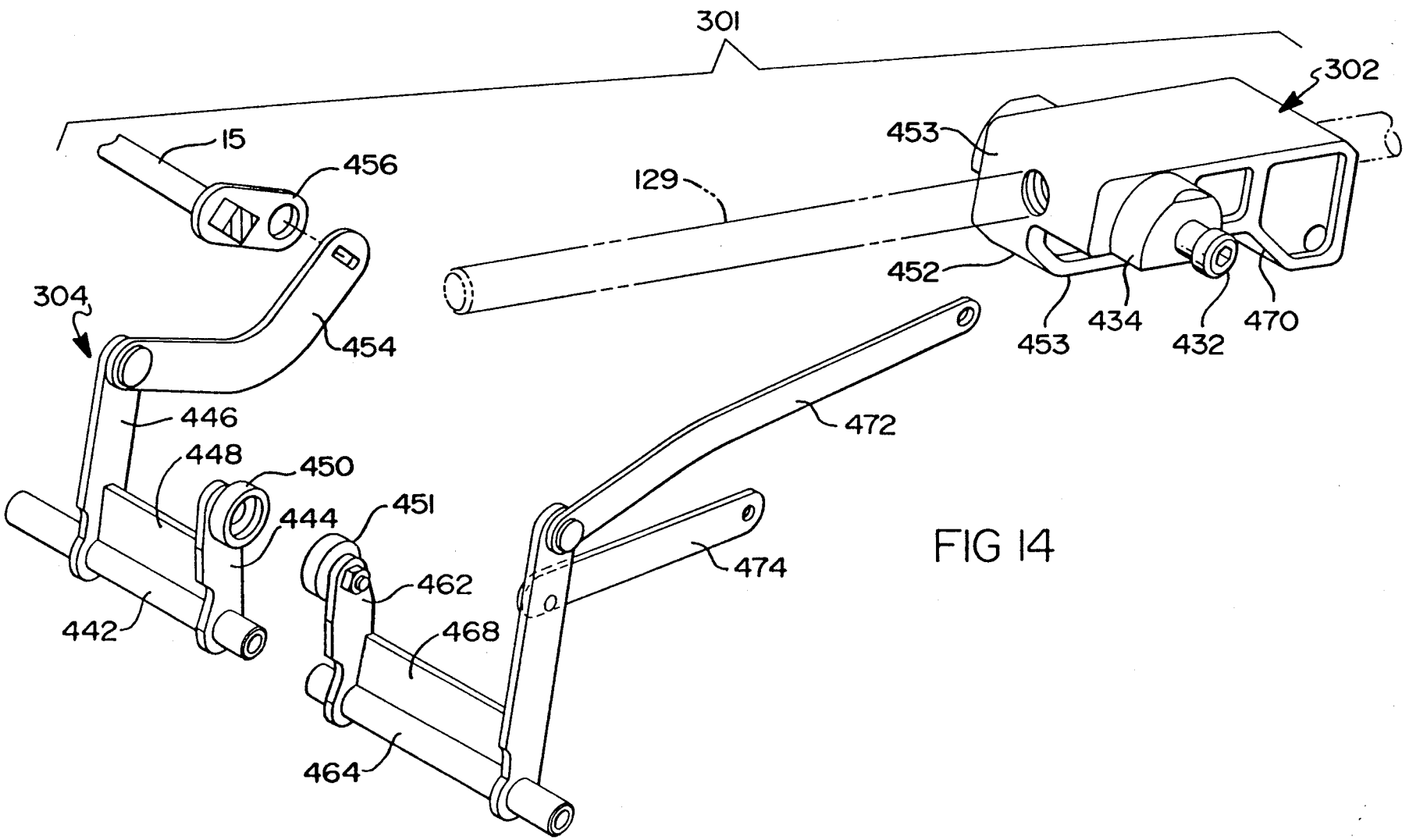
FIG. 14 is an exploded perspective view of the cam guide and follower assemblies of the cam actuation drive mechanism.

As was previously described, switch means are preferably provided at the forward and rearward ends of screw shaft 129 for terminating rotation thereof. As shown in FIG. 10 a limit switch 440 is provided which is adapted to contact a portion of cam guide 302, such as pin 432, for terminating rotation of screw shaft 129 once cam guide 302 has moved forwardly to a position defining a fully reclined seating position with leg rest assembly 13 also fully extended (FIG. 13). A rear limit switch 141 is provided on motor 121 to define a maximum forward tilted position for lift and tilt linkage 97'.

As will be appreciated, the present invention can be easily modified to include one or both of first and second follower assemblies 304 and 306, respectively. As shown, actuation is sequential when both follower assemblies are utilized. As such, it is possible to manufacture various combination recliner chairs 300 by simply eliminating one of the respective follower assemblies or rendering one of the follower assemblies inoperative. Furthermore, drive mechanism 301 is adapted for simple installation into conventional manually actuated drive systems without a significant number of new parts or design changes being required.

Chair 300 is especially useful for invalids since by pressing switch 275 the occupant can change his position on the seat to provide greater comfort when desired. If the disability of the occupant is such as to render the occupant unable to reach switches mounted on the side of chair 300, it is within the purview of the invention to provide a switch box which may rest on his lap and be operated by the simple movement of a finger.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A power-assist chair comprising:

a base assembly;

a chair frame pivotally supported on said base assembly;

a seat assembly having a seat member, a seat back and swing link means for pivotally interconnecting said seat back and said seat member to said chair frame for reclining movement between an upright position and a reclined position;

a rotatable drive shaft extending transversely between opposite side portions of said chair frame;

a leg rest assembly supported from said chair frame and operatively coupled to said drive shaft for movement between a retracted position upon rotation of said drive shaft in a first direction, and an extended position upon rotation of said drive shaft in a second direction;

first follower means supported for pivotal movement on said base assembly and operably interconnected to said drive shaft;

second follower means supported for pivotal movement on said base assembly and operably interconnected to said swing link means;

linear actuation means for selectively actuating said swing link means and said leg rest assembly, said linear actuation means including a cam guide member adapted for translational movement and having first cam surface means engageable with said first follower means for causing corresponding rotation of said drive shaft in said second direction so as to extend said leg rest assembly, and second cam surface means engageable with said second follower means for causing corresponding movement of said swing link means so as to move said seat assembly to said reclined position; and spring return means for biasing said first and second follower means in opposition to said first and second cam surface means, respectively, such that said leg rest assembly is biased toward said retracted position and said swing link means is biased toward said upright position.

2. The power-assist chair of claim 1 wherein said cam guide member is configured to have one of said first and second cam surface means operatively displaced from the other such that upon movement of said cam guide member toward said first and second cam surface means said cam guide member engages one of said first and second follower means prior to engaging the other thereof whereby actuation of said leg rest assembly and said swing link means is independent and sequential.

3. The power-assist chair of claim 1 wherein said linear actuation means comprises an electric motor, a screw shaft rotatably driven by said motor, and wherein said cam guide member has internal threads received on said screw shaft such that selective energization of said motor causes said screw shaft to rotate in a first direction for causing forward movement of said cam guide toward said first and second follower means, and wherein said motor may be energized for generating rotation of said screw shaft in an opposite second direction for causing rearward movement of said cam guide away from said first and second follower means.

4. The power-assist chair of claim 3 wherein said first follower means includes a first cam lever adapted to engage said first cam surface means of said cam guide member, and first linkage means operatively coupling said first cam lever to said drive shaft, whereby forward movement of said cam guide member causes said first cam surface means to engage said first cam lever for pivoting said first cam lever such that said first linkage means generates corresponding rotation of said drive shaft for moving said leg rest to said extended position.

5. The power-assist chair of claim 4 wherein said second follower means includes a second cam lever adapted to engage said second cam surface means, and second linkage means operatively coupling said second cam lever to said swing linkage means, whereby continued forward movement of said cam guide member causes said second cam surface means to engage said second cam lever for pivoting said second cam lever such that said second linkage means generates corresponding movement of said swing link means for moving said seat assembly to said reclined position.

6. The power-assist chair of claim 5 wherein said first cam surface means is located forward of said second cam surface means on said cam guide member such that forward movement thereof on said screw shaft generates extended actuation of said leg rest assembly prior to reclining actuation of said swing link assembly, said first cam surface means having planar surface means adjacent thereto for limiting the angular movement of said first cam lever following complete extension of said leg rest assembly.

7. The power-assist chair of claim 5 wherein said swing link means includes a first pair of swing linkages supported on opposite rear side portions of said chair frame and interconnecting said seat assembly to said chair frame, said first pair of swing linkages interconnected by a transverse cross member which is operatively coupled to said second linkage means for moving said swing link means forwardly upon said cam guide member pivotably moving said second cam lever.

8. A power-assist chair of claim 7 wherein said swing link means further includes a second pair of swing linkages supported between and operatively interconnecting front side portions of said chair frame and said seat member, said second pair of swing linkages adapted to tilt said chair frame relative to said base assembly during extension of said leg rest assembly and to pull said seat member forwardly upon forward movement of said cross member.

9. The power-assist chair of claim 7 wherein said leg rest assembly includes pantograph linkage means operatively connected to said drive shaft such that rotation of said drive shaft moves said leg rest assembly and movement of said leg rest assembly moves said drive shaft, and wherein said spring return means includes a first spring interconnecting said pantograph linkage means to said base assembly such that upon rearward movement of said cam guide member said first spring urges said pantograph linkage toward its retracted position.

10. The power-assist chair of claim 9 wherein said spring return means further includes a second spring member interconnecting said second follower means to said base assembly such that upon rearward movement of said cam guide member said second spring member urges said swing link means rearwardly such that said chair frame is biased toward said upright position.

11. The power-assist chair of claim 10 further comprising lift means operatively interconnecting said chair frame to said base assembly for elevating and tilting said chair frame, said lift means operatively associated with said linear actuation means such that rearward movement of said cam guide actuates said lift means to move said chair frame to an elevated-tilted position and forward movement of said cam guide lowers said chair frame from said elevated-tilted position to a normal seating position.

12. A power-assist chair of claim 11 wherein said lift means comprises a stationary rectangular lower frame adapted to rest on a floor, a movable rectangular upper frame, said upper frame providing support means on which said chair frame is mounted, a lift bar member pivoted at one end to a central portion of said lower frame and extending longitudinally forwardly from said pivot and being located substantially within the confines of said lower frame when said lift means is in a fully lowered position, the other and front end of said lift bar member being pivoted to the front end of said upper frame, said motor being pivoted to a rear portion of said lower frame for arcuate motion of said screw shaft in a vertical plane, bracket means supported on said lift bar which extend upwardly within the confines of said upper frame when said lift means is in said lowered position and which define elongated slots, said cam guide member having pins extending through said elongated slots in said bracket means, whereby rearward movement of said cam guide member along the length of said screw shaft until said pins engage a rearward end of said slots causes said cam guide member to elevate said upper frame, and wherein forward longitudinal movement of said cam guide lowers said upper frame, said lift means further including tilt linkage means connected to said upper frame for pivoting said upper frame about a pivot axis of said lift bar when said upper frame is elevated or lowered.

13. The power-assist chair of claim 12 wherein said lift means is adapted to move said chair frame to said elevated-tilted position from said normal lowered position upon said cam guide member being moved rearwardly from a neutral position of non-engagement with said first and second follower means, forward movement of said cam guide member toward said neutral position causes said chair frame to move toward said normal lowered position from said elevated-tilted position, and wherein said leg rest assembly and swing link means are adapted to be actuated from said normal lowered position upon said cam guide member moving forwardly beyond said neutral position.

14. A power-assist chair of claim 13 wherein said tilt linkage means comprises a tilt bar member pivoted at its rear end to said lower frame and extending longitudinally forwardly from said rear end pivot and being located substantially within the confines of said upper frame when said lift means is in said lowered position, the front end of said tilt bar member being pivoted to the front end of said lower frame.

15. A drive mechanism for use in power-assisted chairs of the type having a base, a chair frame supported on the base, an extensible leg rest assembly and a reclinable seat assembly having swing linkages pivotally interconnecting a seat back and a seat frame relative to the chair frame, said drive mechanism comprising:

shaft means for operatively connecting said leg rest assembly to said chair frame, said shaft means operable for rotation in a first direction for moving said leg rest assembly to an extended position, and said shaft means rotatable in an opposite second direction for moving said leg rest assembly to a retracted position;

a first follower assembly supported for pivotal movement on said base;

first linkage means operatively coupling said first follower assembly to said shaft means;

a second follower assembly supported for pivotal movement on said base;

second linkage means interconnecting said second follower assembly to said swing link means;

linear actuation means for selectively actuating said swing link means and said leg rest assembly, said linear actuation means including a cam guide member adapted for translational movement and having first cam surface means engageable with said first follower assembly for causing said shaft means to rotate in said first direction for extending said leg rest assembly, said cam guide member having second cam surface means adapted to engage said second follower assembly for causing said swing linkages to move said seat assembly from an upright position to a reclined position;

first spring return means operatively interconnecting one of said first follower assembly and said leg rest assembly to said base for biasing sad leg rest assembly toward a retracted position;

second spring return means operatively interconnecting said second follower assembly to said base for biasing said seat assembly to said upright position; and said linear actuation means including power operated means adapted for selectively moving said cam guide member in a first direction toward said first and second follower assemblies and in a second direction away from said first and second follower assemblies.

16. The drive mechanism of claim 15 wherein said cam guide member is configured to have one of said first and second cam surface means operatively displaced from the other such that upon movement of said cam guide member toward said first and second cam surface means said cam guide member engages one of said first and second follower assemblies prior to engaging the other thereof whereby actuation of said leg rest assembly and said swing linkage is independent and sequential.

17. The drive mechanism of claim 15 wherein said power operated means comprises an electric motor, a screw shaft rotatably driven by said motor, and wherein said cam guide member has internal threads received on said screw shaft such that selective energization of said motor causes said screw shaft to rotate in a direction causing forward translational movement of said cam guide toward said first and second follower assemblies, and wherein said motor may be energized for generating rotation of said screw shaft in an opposite direction for causing rearward translation movement of said cam guide away from said first and second follower assemblies.

18. The drive mechanism of claim 17 wherein said first follower assembly includes a first cam lever adapted to engage said first cam surface means of said cam guide member, said first linkage means operatively coupling said first cam lever to said shaft means, whereby forward movement of said cam guide member causes said first cam surface means to engage said first cam lever for pivoting said first cam lever such that said first linkage means generates corresponding rotation of said shaft means for moving said leg rest assembly to said extended position.

19. The drive mechanism of claim 18 wherein said second follower assembly includes a second cam lever adapted to engage said second cam surface means, said second linkage means operatively coupling said second cam lever to said swing linkage, whereby continued forward movement of said cam guide member causes said second cam surface means to engage said second cam lever for pivoting said second cam lever such that said second linkage means generates corresponding movement of said swing linkage for moving said seat assembly to said reclined position.

20. The drive mechanism of claim 19 wherein said first spring return means is a spring member interconnecting said first linkage means to said base such that upon rearward movement of said cam guide member said spring member biases said first follower assembly for urging said leg rest assembly toward its retracted position.

21. The drive mechanism of claim 20 wherein said second spring return means includes a second spring member interconnecting said second follower assembly to said base such that upon rearward movement of said cam guide member said second spring member urges said swing linkage rearwardly such that said chair frame is biased toward said upright position.

22. The drive mechanism of claim 21 further comprising lift means operatively interconnecting said chair frame to said base for elevating and tilting said chair frame, said lift means operatively associated with said power operated means such that rearward movement of said cam guide actuates said lift means for moving said chair frame to an elevated-tilted position and forward movement of said cam guide lowers said chair frame from said elevated-tilted position to a lowered seating position.

23. The drive mechanism of claim 21 wherein said lift means comprises a stationary rectangular lower frame adapted to rest on a floor, a movable rectangular upper frame, said upper frame providing support means on which said chair frame is mounted, a lift bar member pivoted at one end to a central portion of said lower frame and extending longitudinally forwardly from said pivot and being located substantially within the confines of said lower frame when said lift means is in a fully lowered position, the other and front end of said lift bar member being pivoted to the front end of said upper frame, said motor being pivoted to a rear portion of said lower frame for arcuate motion of said screw shaft in a vertical plane, bracket means supported on said lift bar which extend upwardly within the confines of said upper frame when said lift means is in said lowered position and which define elongated slots, said cam guide member having pins extending through said elongated slots in said bracket means, whereby rearward movement of said cam guide member along the length of said screw shaft until said pins engage a rearward end of said slots causes said cam guide member to elevate said upper frame, and wherein forward longitudinal movement of said cam guide lowers said upper frame, said lift means further including tilt linkage means connected to said upper frame for pivoting said upper frame about a pivot axis of said lift bar when said upper frame is elevated or lowered.

24. The drive mechanism of claim 23 wherein said lift means is adapted to move said chair frame to said elevated-tilted position from said normal lowered position upon said cam guide member being moved rearwardly from a neutral position of non-engagement with said first and second follower means, forward movement of said cam guide member toward said neutral position causes said chair frame to move toward said normal lowered position from said elevated-tilted position, and wherein said leg rest assembly and swing link means are adapted to be actuated from said normal lowered position upon said cam guide member moving forwardly beyond said neutral position.

25. A power-assist chair comprising:

a base assembly;

a chair frame pivotally supported on said base assembly;

lift means interconnecting said chair frame to said base assembly for movement between a lowered seating position and an elevated-tilted position;

a seat assembly having a seat member, a seat back and swing link means for pivotally interconnecting said seat back an said seat member to said chair frame for reclining movement between an upright position and a reclined position;

a rotatable drive shaft extending transversely between opposite side portions of said chair frame;

a leg rest assembly supported from said chair frame and operatively coupled to said drive shaft for movement between a retracted position upon rotation of said drive shaft in a first direction, and an extended position upon rotation of said drive shaft in a second direction;

a first follower assembly supported for pivotal movement on said lift means and operably interconnected to said drive shaft;

a second follower assembly supported for pivotal movement on said lift means and operably interconnected to said swing link means;

linear actuation means for selectively actuating said lift means, said swing link means and said leg rest assembly, said linear actuation means including a cam guide member adapted for translational movement and having first cam surface means engageable with said first follower assembly and second cam surface means engageable with said second follower assembly;

said linear actuation means having power operated means adapted for selectively causing said cam guide member to move with respect thereto, whereby movement of said cam guide member in a first direction moves said chair frame from a neutral position defined by said chair frame being in said lower-seating position to said elevated-tilted position, movement of said cam guide member in a second direction with respect to said power operated means adapted to cause said lift means to lower said chair frame from said elevated-tilted position to said lowered-seating position, and wherein continued movement of said cam guide member in said second direction past said neutral position causes said first cam surface means to engage said first follower assembly for generating corresponding rotation of said drive shaft so as to extend said leg rest assembly, and continued movement of said cam guide member in said second direction causes said second cam surface means to engage said second follower assembly for generating corresponding movement of said swing link means so as to move said seat assembly to said reclined position; and spring return means for biasing said first and second follower assemblies in opposition to said first and second cam surface means, respectively, such that said leg rest assembly is biased toward said retracted position and said seat assembly is biased toward said upright position.

* * * * *